US008618419B2

(12) United States Patent
Fukasaku et al.

(10) Patent No.: US 8,618,419 B2
(45) Date of Patent: Dec. 31, 2013

(54) ELECTRIC COMPRESSOR

(75) Inventors: Hiroshi Fukasaku, Kariya (JP); Hiroyuki Gennami, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 109 days.

(21) Appl. No.: 13/411,850

(22) Filed: Mar. 5, 2012

(65) Prior Publication Data

US 2012/0228023 A1 Sep. 13, 2012

(30) Foreign Application Priority Data

Mar. 8, 2011 (JP) ..... 2011-049872

(51) Int. Cl.
*H01B 17/26* (2006.01)

(52) U.S. Cl.
USPC ..... 174/152 GM; 417/422; 417/902; 439/926

(58) Field of Classification Search
USPC ..... 174/564, 152 GM; 417/422, 902; 439/926
See application file for complete search history.

(56) References Cited

U.S. PATENT DOCUMENTS 5,629,574 A * 5/1997 Cognetti et al. ..... 310/71
2001/0005659 A1 6/2001 Fukumoto et al.
2003/0234115 A1* 12/2003 Deng et al. ..... 174/65 R
2008/0067884 A1* 3/2008 Handwerker ..... 310/71
2011/0158833 A1 6/2011 Murakami et al.

FOREIGN PATENT DOCUMENTS

| | | | |
|---|---|---|---|
| JP | 63-230972 | A | 9/1988 |
| JP | 03-273844 | A | 12/1991 |
| JP | 5-312150 | A | 11/1993 |
| JP | 2001-182655 | A | 7/2001 |
| JP | 2005-307798 | A | 11/2005 |
| JP | 2007-278184 | A | 10/2007 |
| JP | 2010-1882 | A | 1/2010 |
| JP | 2010-168914 | A | 8/2010 |

* cited by examiner

*Primary Examiner* — Hung Ngo
(74) *Attorney, Agent, or Firm* — Sughrue Mion, PLLC

(57) ABSTRACT

An electric compressor includes a compression mechanism, an electric motor that drives the compression mechanism, a compressor housing that accommodates the electric motor and the compression mechanism, an inverter housing coupled to the compressor housing and including an inverter accommodation chamber that accommodates the inverter, and a sealed terminal arranged in the compressor housing. The sealed terminal electrically connects the inverter and the electric motor. The sealed terminal includes a terminal pin, which is formed from a conductive material, a terminal holder, which holds the terminal pin, and an insulative body, which insulates the terminal pin from the terminal holder. The insulative body includes a first insulative body, which is arranged in the inverter accommodation chamber and formed from a ceramic, and a second insulation body, which is arranged in the compressor housing and formed from glass.

5 Claims, 2 Drawing Sheets

ELECTRIC COMPRESSOR

BACKGROUND OF THE INVENTION

The present invention relates to an electric compressor including an electric motor.

An electric compressor includes an electric motor, which is accommodated in a sealed housing. A sealed terminal is arranged on the housing to electrically connect a lead wire of the electric motor and an inverter, which is arranged outside the housing to drive the electric motor. The sealed terminal includes a terminal pin, which is formed from a conductive material, and a metal terminal holder, which holds the terminal pin. An insulative material, such as a ceramic or glass, is arranged between the terminal pin and the terminal holder.

Japanese Patent No. 3910327 (refer to FIG. 5 of the publication) discloses an example of an electric compressor that accommodates a motor and a compression mechanism, which is driven by the motor, in a metal shell. The electric compressor includes a power terminal that is connected by a flag terminal to a lead wire of the motor. To insulate the power terminal of the above publication from a metal terminal base, which forms a metal casing of the electric compressor together with the metal shell, the power terminal is coupled by a glass insulative member and a ceramic insulator to the metal terminal base. The glass insulative member is arranged at the outer side of the metal terminal base. The ceramic insulator is arranged at the inner side of the metal terminal base, that is, inside the metal shell accommodating the motor.

Japanese Laid-Open Patent Publication No. 63-230972 discloses an electric compressor, as a prior art, including a casing that accommodates motor and compression elements. The motor includes a rotor and a stator. The electric compressor includes a sealed terminal fixed to a side wall of the casing. The sealed terminal includes a cup-shaped body, a pin, and a glass seal (insulator) that fastens the pin to the body. Further, Japanese Laid-Open Patent Publication No. 63-230972 describes a problem of the prior art in which heating of the electric elements may carbonize insulative material or lubrication oil and form carbon on the insulator of the sealed terminal in the casing. Since carbon is a good conductor, the carbonization may adversely affect insulation. Thus, in the invention of Japanese Laid-Open Patent Publication No. 63-230972, a cylindrical portion is arranged on a ceramic cluster, which is coupled to the lead wire of the motor elements. The cylindrical portion of the cluster is fitted to an inner wall of the cup-shaped body to cover the glass seal of the sealed terminal and prevent the application of carbon.

In an electric compressor, refrigerant supplied to a compression mechanism is also circulated through the electric motor. In a scroll type electric compressor, for example, a large amount of fine abrasive particles may be contained in the refrigerant and circulated. Fine abrasive particles are produced by wear of portions of the scroll plated with metal or wear of metal components in the electric compressor and an external refrigerant pipe.

In the electric compressor of Japanese Patent No. 3910327, when the ceramic insulator of the power terminal arranged in the electric compressor is exposed to the circulating refrigerant, the fine abrasive particles in the refrigerant are apt to entering and collecting in fine pores of the ceramic insulator. The abrasive particles deposited on the power terminal may cause short-circuiting between the power terminal and the metal terminal base, to which the power terminal is coupled. This may result in the leakage of electric current to the metal casing of the electric compressor.

In the electric compressor of Japanese Laid-Open Patent Publication No. 63-230972, the cluster, which covers the glass seal used for fastening and insulation of the pin in the sealed terminal, is formed from a ceramic. Thus, in the same manner as Japanese Patent No. 3910327, a large amount of abrasive particles may be collected and deposited on the ceramic thereby causing short-circuiting between the pin and body or between the pin and casing.

In the prior art described in Japanese Laid-Open Patent Publication No. 63-230972, the glass seal, which serves as an insulative member, is arranged in the casing. Thus, abrasive particles in the refrigerant do not collect on the glass seal. However, when using the glass seal as an insulative member, a glass chip must be arranged between the body and pin. The glass chip is heated and melted for adhesion. Since the melted glass chip falls due to self-weight, the thickness of the glass seal cannot be increased. Accordingly, to obtain a sufficient insulating performance, the insulation distance can be increased by melting the glass seal for adhesion over a long distance in the axial direction of the pin inside and outside the body. However, this elongates the pin, which projects out of the body. Thus, when using an inverter to drive the electric motor, the coupling position of the inverter would be greatly separated outward from the casing. This enlarges the entire electric compressor, which is problematic.

SUMMARY OF THE INVENTION

It is an object of the present invention to provide an electric compressor that prevents metal abrasive particles from collecting on a sealed terminal without enlarging the electric compressor.

One aspect of the present invention is an electric compressor including a compression mechanism. An electric motor drives the compression mechanism. An inverter drives the electric motor. A compressor housing accommodates the electric motor and the compression mechanism. An inverter housing is coupled to the compressor housing. The inverter housing defines an inverter accommodation chamber that accommodates the inverter. A sealed terminal is arranged in the compressor housing. The sealed terminal electrically connects the inverter and the electric motor. The sealed terminal includes a terminal pin, which is formed from a conductive material, a terminal holder, which holds the terminal pin, and an insulative body, which insulates the terminal pin from the terminal holder. The insulative body includes a first insulative body, which is arranged in the inverter accommodation chamber and formed from a ceramic, and a second insulation body, which is arranged in the compressor housing and formed from glass.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
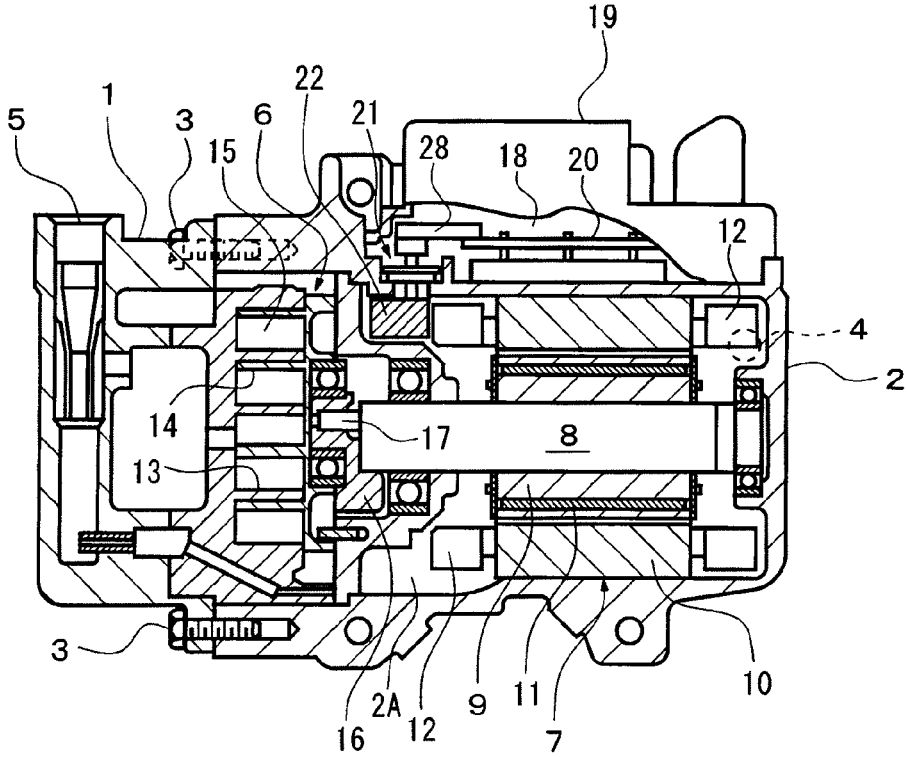
FIG. 1 is a cross-sectional view showing a scroll type electric compressor according to one embodiment of the present invention.

One embodiment of the present invention will now be described with reference to FIGS. 1 to 4. FIG. 1 shows a scroll type electric compressor including a sealed compressor housing, which is formed by integrally joining a front housing member 1 and a rear housing member 2 with a plurality of bolts 3. The housing members 1 and 2 are both formed from a metal material such as aluminum or aluminum alloy. The housing member 2 includes a suction port 4. The housing member 1 includes a discharge port 5. The suction port 4 and discharge port 5 are connected to an external refrigerant circuit (not shown).

The housing members 1 and 2 define an interior 2A that accommodates a scroll type compression mechanism 6 and an electric motor 7, which drives the compression mechanism 6. The electric motor 7 includes a rotation shaft 8, a rotor 9, and a stator 10. The rotation shaft 8 is held by bearings to be rotatable in the housing member 2. The rotor 9 is fixed to the rotation shaft 8. The stator 10 is arranged outside the rotor 9 and fixed to an inner wall of the housing member 2. The rotor 9 includes a plurality of permanent magnets 11. The stator 10 includes coils 12 wound in three phases.

The compression mechanism 6 includes a fixed scroll 13, which is fixed to inner walls of the housing members 1 and 2, and a movable scroll 14, which is arranged facing the fixed scroll 13. A compression chamber 15 having a variable volume is defined between the fixed scroll 13 and movable scroll 14 to compress refrigerant. The movable scroll 14 is coupled by a bearing and an eccentric bushing 16 to an eccentric pin 17 of the rotation shaft 8. Thus, when the rotation shaft 8 rotates, the movable scroll 14 orbits (revolves) about the axis of the rotation shaft 8 thereby varying the volume of the compression chamber 15.

An inverter housing 19, which defines an inverter accommodation chamber 18, is fixed to part of the outer wall of the housing member 2. In the inverter accommodation chamber 18, an inverter 20, which functions as an external power supply, and a sealed terminal 21 are coupled to the outer wall of the housing member 2. The sealed terminal 21 is electrically connected by an inverter connector 28 to the inverter 20 in the inverter accommodation chamber 18. Further, the sealed terminal 21 is electrically connected to lead wires (not shown) that extends from the coils 12 of the stator 10 through a cluster block 22 in the interior 2A of the housing member 2. Accordingly, when current is supplied from the inverter 20 via the sealed terminal 21 to the coils 12 of the electric motor 7, the rotor 9 is rotated, and the rotation shaft 8 actuates the compression mechanism 6.

Figure 2:
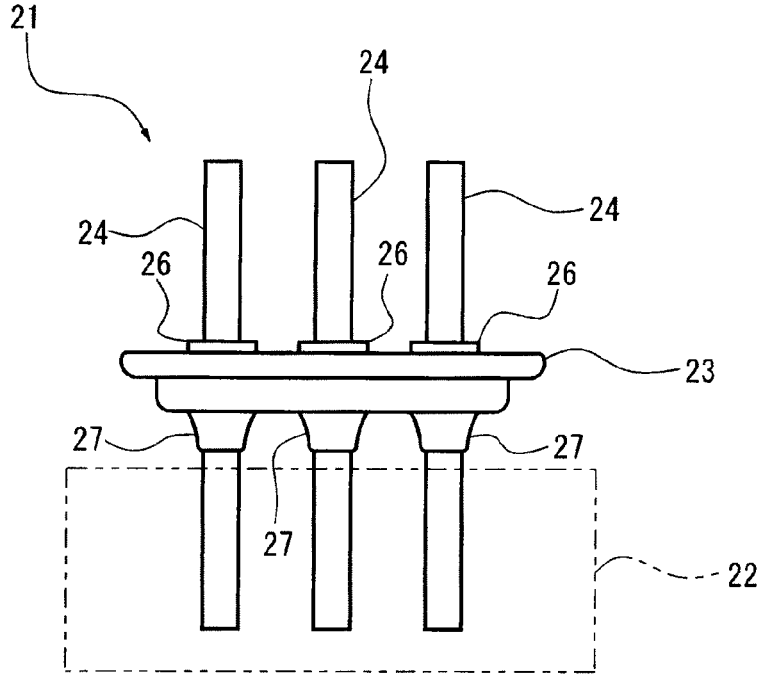
FIG. 2 is a front view showing a sealed terminal of FIG. 1.
Figure 3:
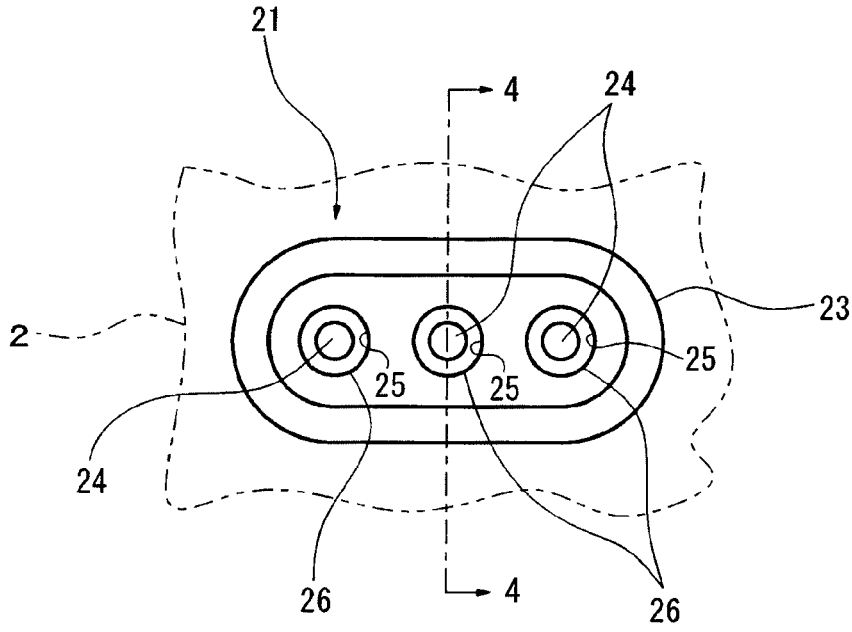
FIG. 3 is a plan view of FIG. 2.
Figure 4:
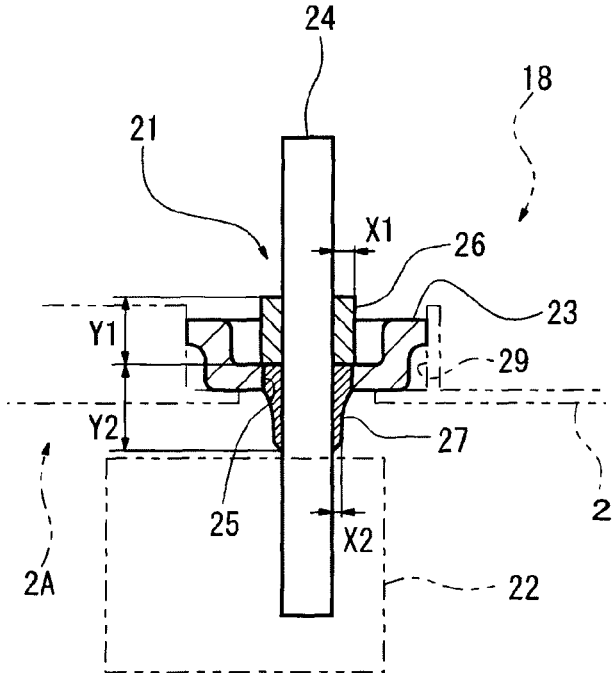
FIG. 4 is a cross-sectional view taken along line 4-4 in FIG. 3.

As shown in FIGS. 2 to 4, the sealed terminal 21 includes an elongated bowl-shaped terminal holder 23 and three rod-shaped terminal pins 24. The terminal holder 23 is arranged in and fixed to an opening 29 (refer to FIG. 4) of the housing member 2 by an O-ring and a snap ring (not shown) so as to hermetically seal the housing member 2. The sealed terminal 21 is formed to be electrically connectable between the electric motor 7, which is arranged in the interior 2A of the sealed housing member 2, and the inverter 20, which is arranged in the inverter accommodation chamber 18 outside the housing member 2, via the connector 28 and the cluster block 22 while maintaining the housing member 2 in the sealed state.

The terminal holder 23 is formed from a metal material, such as steel, and includes three through-holes 25 (refer to FIGS. 3 and 4). Each terminal pin 24 is formed from a conductive material and inserted into and held by one of the holes 25 in the terminal holder 23 by means of a first insulative body 26, which is arranged in the inverter accommodation chamber 18, and a second insulative body 27, which is arranged in the interior 2A of the housing member 2.

The first insulative body 26 is a cylindrical body sintered to have a determined thickness and formed from a ceramic oxide, such as zirconia, or other types of ceramic. The first insulative body 26 is fitted and fixed to the terminal pin 24. Ceramic allows for the thickness X1 of the first insulative body 26 to be freely set. This ensures that a sufficient insulation distance can be obtained between the terminal holder 23 and the terminal pin 24 by increasing the thickness X1 of the cylindrical body. Thus, the length Y1 of the first insulative body 26 in the axial direction of the terminal pin 24 can be minimized. In other words, the first insulation body 26 can be short.

The second insulation body 27 is formed from glass. To manufacture the second insulation body 27, the first insulation body 26 is fixed to the terminal pin 24. Then, a glass chip is arranged in a gap between the terminal pin 24 and an inner periphery of the corresponding hole 25 in the terminal holder 23. The glass chip is heated and melted. Part of the melted glass falls around the terminal pin 24 due to self-weight and adheres to the entire circumferential surface of the terminal pin 24. The remaining part of the melted glass adheres to the wall of the hole 25 and an end surface of the first insulation body 26 (specifically, the end surface facing the inner side of the compressor housing). Since the second insulation body 27 adheres to the terminal pin 24, the thickness X2 of the second insulation body 27 cannot be increased as desired. Accordingly, the required insulation distance between the terminal holder 23 and the terminal pin 24 is ensured by increasing the length Y2 of the second insulation body 27 in the axial direction of the terminal pin 24.

The above embodiment has the advantages described below.

During operation of the electric compressor, refrigerant drawn through the suction port 4 is flowed from the electric motor 7 to the compression mechanism 6. Then, the refrigerant is compressed by the compression mechanism 6 and supplied to the external refrigerant circuit (not shown). Accordingly, a portion of the sealed terminal 21 arranged in the interior 2A of the housing member 2 is constantly exposed to the refrigerant. A large amount of abrasive particles may be suspended in the refrigerant. However, the second insulation bodies 27 arranged in the interior 2A of the housing member 2 is formed from glass, and abrasive particles do not collect on the second insulation bodies 27. Thus, short-circuiting caused by abrasive particles does not occur between the terminal holder 23 and the terminal pins 24, and electric current does not leak from the electric compressor. This prevents the operation efficiency of the electric compressor from decreasing.

Further, the abrasive particles suspended in the refrigerant does not collect on the first insulation bodies 26 of the terminal pins 24 arranged in the inverter accommodation chamber 18, which is located outside the housing member 2. Thus, the first insulation bodies 26 can be formed from a ceramic material. This allows for the length of each first insulation body 26 to be minimized thereby eliminating the need to raise the locations of the inverter 20 and the connector 28. Thus, enlargement of the electric compressor can be avoided.

The second insulation bodies 27 are formed from glass. Thus, the second insulation bodies 27 can be melted to fix the terminal holder 23 and the terminal pins 24. More specifically, each second insulative body 27 functions as a fastening member that fastens the corresponding terminal pin 24 to the terminal holder 23. Thus, for example, when the first and second insulation bodies 26 and 27 are both formed from a ceramic like in the prior art, a further means for fastening the terminal pin 24 to the terminal holder 23 would be necessary. However, in the above embodiment, such a fastening means is not necessary. This simplifies the manufacturing process of the sealed terminal.

It should be apparent to those skilled in the art that the present invention may be embodied in many other specific forms without departing from the spirit or scope of the invention. Particularly, it should be understood that the present invention may be embodied in the following forms.

(1) In the above embodiment, three terminal pins 24 are fixed to the single terminal holder 23. However, the terminal holder 23 may be provided for each of the three terminal pins 24 so that a single terminal pin 24 is fixed to each terminal holder.

(2) The terminal holder 23 does not need to have an elongated shape as shown in FIGS. 2 to 4 and may have any of a variety of shapes.

(3) Instead of using the second insulation bodies 27 for the fastening of the terminal holder 23 and the terminal pins 24, an adhesive agent of, for example, an insulative resin may be used. The use of an insulative resin as the adhesive agent is beneficial in terms of cost.

(4) The second insulative bodies 27 do not have to be melted for adhesion to the terminal pins 24, and other procedures may be taken for the adhesion.

(5) In the above embodiment, the present invention is applied to a scroll type electric compressor. However, the electric compressor that includes an electric motor may be of a different rotary type compressor, such as vane type compressor and a screw type compressor, or a reciprocation type compressor, such as a swash type compressor and a wobble type compressor.

The present examples and embodiments are to be considered as illustrative and not restrictive, and the invention is not to be limited to the details given herein, but may be modified within the scope and equivalence of the appended claims.

The invention claimed is:

1. An electric compressor comprising:

a compression mechanism;

an electric motor that drives the compression mechanism;

an inverter that drives the electric motor;

a compressor housing that accommodates the electric motor and the compression mechanism;

an inverter housing coupled to the compressor housing, wherein the inverter housing defines an inverter accommodation chamber that accommodates the inverter; and a sealed terminal arranged in the compressor housing, wherein the sealed terminal electrically connects the inverter and the electric motor, the sealed terminal includes a terminal pin, which is formed from a conductive material, a terminal holder, which holds the terminal pin, and an insulative body, which insulates the terminal pin from the terminal holder, and the insulative body includes a first insulative body, which is arranged in the inverter accommodation chamber and formed from a ceramic, and a second insulation body, which is arranged in the compressor housing and formed from glass.

2. The electric compressor according to claim 1, wherein the terminal holder includes a through-hole into which the terminal pin is inserted, and part of the second insulation body is arranged between the terminal pin and an inner periphery of the through-hole.

3. The electric compressor according to claim 2, wherein the second insulative body is adhered to a surface of the terminal pin and the wall of the through-hole so as to function as a fastening member that fastens the terminal pin to the terminal holder.

4. The electric compressor according to claim 3, wherein the first insulation body is fitted to the terminal pin, and the second insulation body is adhered to an end surface of the first insulation body that faces an inner side of the compressor housing.

5. The electric compressor according to claim 1, wherein the compressor housing includes an opening that communicates an interior of the compressor housing with the inverter accommodation chamber, and the sealed terminal is fixed to the compressor housing so as to hermetically seal the opening.

* * * * *